US007878968B2

(12) United States Patent
Wittmann-Price et al.

(10) Patent No.: US 7,878,968 B2
(45) Date of Patent: Feb. 1, 2011

(54) SENSORY DEVELOPMENTAL CAP

(75) Inventors: Ruth Wittmann-Price, Bethlehem, PA (US); Andrew Unger, Bethlehem, PA (US); Gayle H. Thear, Macungie, PA (US); Edward G. Thear, Macungie, PA (US)

(73) Assignee: Neatcap, LLC, Macungie, PA (US)

( * ) Notice: Subject to any disclaimer, the term of this patent is extended or adjusted under 35 U.S.C. 154(b) by 72 days.

(21) Appl. No.: 12/105,569

(22) Filed: Apr. 18, 2008

(65) Prior Publication Data

US 2009/0260134 A1 Oct. 22, 2009

(51) Int. Cl.
*A61M 21/00* (2006.01)

(52) U.S. Cl. ..... 600/28

(58) Field of Classification Search ..... 600/26–28, 600/21–22; 2/410, 423, 171, 171.2, 171.4, 2/173, 208; 128/846, 857, 858, 864
See application file for complete search history.

(56) References Cited

U.S. PATENT DOCUMENTS

| | | | | |
|---|---|---|---|---|
| 3,809,065 | A * | 5/1974 | Gatts | 600/22 |
| 4,644,588 | A * | 2/1987 | Zawacki | 2/10 |
| 5,205,811 | A * | 4/1993 | Fornarelli | 600/28 |
| 5,243,709 | A * | 9/1993 | Sheehan et al. | 2/209 |
| 6,004,259 | A * | 12/1999 | Sedaros | 600/28 |
| 6,571,799 | B1 * | 6/2003 | Daly | 128/857 |
| 6,918,770 | B2 * | 7/2005 | Odiwo | 434/262 |
| 7,510,521 | B2 * | 3/2009 | Bennett | 600/28 |
| 2007/0154046 | A1 * | 7/2007 | Mishan | 381/370 |

OTHER PUBLICATIONS

D'Agati, Suzanne S. (1995). The Effects of a Sound-Modified Environment on Physiological Variables in Premature Infants in Neonatal Intensive Care. Dissertation Abstracts International, 5605B, p. 2545, 71 pages.*

Spence MJ, Freeman MS. Newborn Infants Prefer the Maternal Low-Pass Filtered Voice, But Not the Maternal Whispered Voice. Infant Behavior and Development 19, 199-212, 1996.*

Stanley N. Graven, MD., Sound and Developing Infant in the NICU, The Full-Term and Premature Newborn, Journal of Perinatology, 2000, 20:p. S88-S93, Nature America, Inc., USA.

M. Kathleen Philbin, RN, PhD, The Influence of Auditory Experience on the Behavior of Preterm Newborns, The Full-Term and Premature Newborn, Journal of Perinatology, 2000, 20:p. S76-S84, Nature America, Inc., USA.

* cited by examiner

*Primary Examiner*—Charles A Marmor, II
*Assistant Examiner*—Catherine E. Burk
(74) *Attorney, Agent, or Firm*—Design IP

(57) ABSTRACT

A cap having ear pieces and an eyepiece. The ear pieces are preferably connected to an audio device that can play stored audio and/or rebroadcast ambient sounds at a reduced audio level. The ear pieces preferable provide sound attenuation of at least 20 dB. The stored audio may include sounds that simulate sounds heard by a fetus while in the womb. The eye piece is preferably removable.

8 Claims, 1 Drawing Sheet

1
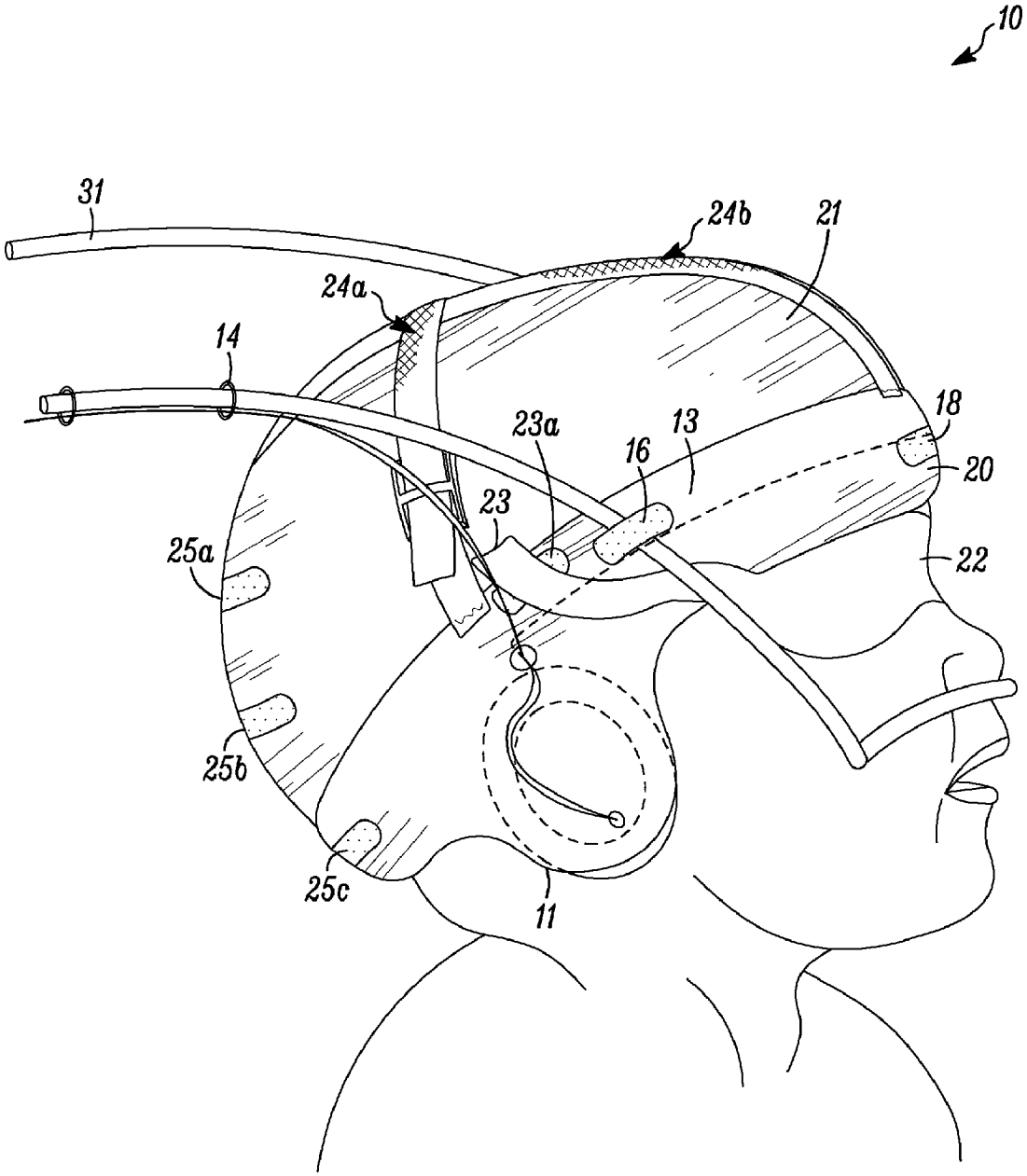

SENSORY DEVELOPMENTAL CAP

FIELD OF INVENTION

The present invention relates to headwear that is designed to manage the visual and aural sensory input of young children, including pre-term infants.

BACKGROUND

Preterm/premature infants (hereinafter "preterm infants") account for approximately 12.5% of births in the United States. Preterm infants may benefit from different environmental stimuli than full term infants because neurodevelopment of preterm infants is incomplete and brain development is still in progress at the time of premature birth. Studies have shown that the total brain weight achieved at 34 weeks can be as little as 65% of that of a full term infant. At this stage of brain development, myelination is incomplete and significant neuro-networking still needs to take place. It has been shown that cerebral cortex volume and cerebellar growth in preterm infants tend to be underdeveloped and preterm infants studied have exhibited decreased cerebellum growth when compared to full term counterparts. Some studies suggest that such decreased cerebellum growth could be the result of abnormal sensory input. Other studies propose a syntactive model that assumes development occurs by continuous interaction with the environment assisting integration of the autonomic nervous and motor systems. Based on this model, over-stimulation from the environment may detrimentally affect developmental outcomes.

Based on these studies, there have been attempts to adapt neonatal intensive care units (hereinafter "NICU") to reduce abnormal sensory inputs, by reducing environmental noise and light levels. Examples of such efforts include low-noise incubation equipment and installation of sound-absorbing materials in floors, walls and ceilings. Such efforts have proven expensive and, in most cases, cannot reduce environmental noise and light to desired levels for preterm infants.

Some hospitals now use single-bed NICU rooms. With this arrangement, more control of external stimuli is possible and the goal is to provide opportunity for improved neurodevelopment. Even in these units, however, the noise created by and the light need for the attending staff to function can result in acoustic and visual environment levels for the preterm infant exceeding those in its natural state and thus potentially adversely affecting neurodevelopment. The single bed NICU has been shown to be only partially effective and can be also be cost prohibitive for many institutions. Thus a less costly and more effective means of environmental control for preterm infants is needed.

SUMMARY

In one respect the invention comprises a cap for a head of a person having a shell shaped to secure the cap on the head. Left and right earpieces are located over and/or in the person's left and right ears, respectively, when the fabric shell or material is positioned on the person's head and each of the left and right earpieces is in a first position. The left and right earpieces each preferably provide sound attenuation. At least one guide, secured to the cap and adapted to retain medical tubing, is also preferably provided.

In another respect, the invention comprises a cap for a head of a preterm infant. The cap preferably includes a fabric shell shaped to secure the cap on the head, left and right earpieces that are located over and/or in the person's left and right ears, respectively, when the fabric shell is positioned on the person's head of the person and each of the left and right earpieces is in a first position. The left and right earpieces each preferably provide sound attenuation of at least 20 dBA.

In yet another respect, the invention comprises providing an infant with an AAVE (Ambient Auditory and Visual Environment), during which the infant is exposed to ambient audio stimuli, providing an infant with a PAVE (Protected Auditory and Visual Environment), during which audio stimuli to the infant is reduced by placing earpieces on the infant's ears which reduce ambient audio levels by at least 20 dB, and alternating between periods of AAVE and PAVE.

BRIEF DESCRIPTION OF THE DRAWING(S)

FIG. 1 is a right-front perspective view of a preferred embodiment of the present invention, shown on the head of a preterm infant.

DETAILED DESCRIPTION OF THE PREFERRED EMBODIMENT(S)

Referring now to FIG. 1, reference numeral 10 refers generally a sensory developmental cap, which constitutes a preferred embodiment of the present invention. It should be understood that the inventive concepts embodied in sensory developmental cap 10 could be implemented in many alternative configurations. In addition, although the emphasis in this embodiment is on pre-term infants, the present invention could be beneficially used with full-term newborns and beyond.

This embodiment, the sensory developmental cap 10 comprises a cap 21 and a support band 20. The cap 21 is preferably made from a soft, breathable, hypoallergenic material with some elasticity. In prototypes of the invention, 100% cotton stockinet material was used, due to its low cost and wide availability. In a commercial embodiment, however, any suitable material could be used. The cap 21 could be a formed from a single piece of material or fabricated using multiple, joined pieces, in order to conform to the shape of the infant's head. The cap 21 provides a basic support structure for components of cap 10, protection for the infant's head and a buffer between the infant's skin and other portions of the cap 10 which may irritate the infant's skin. The band 20 is included to provide additional structural support for components of the cap 21. In a prototype of the invention, Croslite® resin (enveloped in a layer of the fabric of cap 21) was used because it warms and softens with body heat, can mold to shape with little force, and is anti-microbial and light weight. Any suitable alternative material could be used in a commercial embodiment.

In this embodiment, the band 20 and cap 21 are symmetrical from left-to-right in most aspects. Therefore, except where otherwise stated, features on the right half of the cap 21 and band 20 should be understood have corresponding features on the left half, which are not visible in FIG. 1.

Due to the wide variation of preterm, term and post term infant head diameters, the sensory development cap 10 is preferably offered in at least four sizes, ranging from an intended head diameter of 5.1 to 13.4 cm. In order to allow for more precise fit and to enable easier placement and removal of the cap 10, both the band 20 and cap 21 preferably include a sizing adjustment that is similar to a conventional baseball cap, including an opening or slit at the front and/or rear of the cap 10 and tabs 18, 25*a*, 25*b* and 25*c*, which preferably include hook-and-loop fasteners. Corresponding tabs (not shown) are preferably located on the opposite side of the cap 10.

The cap 10 also preferably includes earpieces 11, which are designed to fit over and around the infant's ear. Earpiece 11, which covers the infant's right ear, is shown in FIG. 1. A corresponding earpiece (not shown) for the infant's left ear is preferably provided. It should be understood that, except as otherwise stated, the components of the earpiece for the left ear is a mirror image of the earpiece 11 for the right ear. It is preferable that both earpieces 11 be removable. Any suitable fastening device could be used, such as a bayonet-style connector.

Ambient noise levels of 70-80 dBA are very common in a NICU. The earpiece 11 is designed to reduce such ambient noise levels to no more than 45 dBA at the infant's ears, representing an attenuation of at least 20-40 dBA. There are many earpiece designs that can accomplish the desired attenuation, such as sound-dampening materials, active noise reduction devices, and the like. In-ear and over-the-ear designs could be used. As with the cap 10 material, it is also important for the material(s) that form the earpiece 11 to be soft, breathable and hypoallergenic. In a prototype of the invention, the earpiece 11 was formed using a two-layer design comprising a layer of cellular foam, wrapped in stockinet fabric. In a commercial embodiment, any material or combination of materials meeting the criteria discussed above could be used. In order to maximize comfort, the earpiece 11 preferably surrounds and "cups" the ear, rather than extending into the ear itself.

It has been suggested that, in addition to attenuation of ambient (undesirable) noise, a preterm infant may benefit from being exposed to controlled, desirable sounds. Accordingly, the cap 10 may optionally include means for generating desirable sound at the infant's ears. Such means could an audio device coupled to an earphone positioned within each earpiece 11. When used with a preterm infant, the audio device could preferably be programmed to play sounds similar to those that would be audible to the infant in the womb, such as digestive, cardiovascular and respiratory sounds. Optionally, actual sounds could be recorded from the infant's mother and replayed through the audio device. Alternatively, the audio device could be programmed to rebroadcast sounds from the NICU.

In this embodiment, the audio device comprises a portable MP3 player, such as an iPod Shuffle® audio player, manufactured by Apple Computer, Inc. Of course, any other suitable audio device could be used. The audio device is preferably located remotely from the cap 12 and is connected to the each earpiece 11 via wires 14 or via a wireless connection protocol (such as Bluetooth®). An alternate embodiment, the audio device 12 could be mounted directly on the cap 10. This configuration is not preferred, however, because of the added weight and heat generated by the audio device.

A removable eye shade 22 may optionally be provided to modify and/or control the visual environment of a user infant. The eye shade 22 is preferably made of a soft, flexible, non-irritating fabric. In a prototype, stockinet material was used. Any suitable material could be used, however, on commercial embodiments. For example, a Kendall™ baby shade could be adapted for use with the cap 10. A hook and loop fasteners 23*a* could be used to removably retain the strap 23 portion of the eye shade 22 to the band 20. This would also allow the eye shade 22 to be repositioned for the comfort of the infant. Alternatively, the eye shade 22 would be sewn to the bottom, front edge of the band 20 and flipped upwardly when not in use. In such an embodiment, a hook and loop fastener 18 could be positioned on the band 20 above the eye shade 22, in order to retain the eye shade 22 in a flipped-up position. The eye shade 22 preferably is opaque (or at least semi-opaque).

The eye shade 22 could be advantageously used in combination with phototherapy. Phototherapy is used with infants to combat jaundice and involves the use of "bili lights," which are intended to reduce bilirubin levels. The eye shade 22 could be used during the administration of phototherapy in order to prevent sleep disruption due to the bili lights. Therefore, it is desirable for the eye shade 22 to be sufficiently opaque so as to prevent the infant from being disturbed by the bili lights.

In this embodiment, the cap 10 includes adjustable support strap 24(*a*) runs from side to side over the cap 21 and extends from its attachment point over the ear tab portion of the band 20, right side, to the corresponding and symmetrical point on the left side, not shown. The support strap 24(*a*) has a loop adjustment allowing it to be loosened or tightened as necessary to obtain the desired fit of the cap 10 on the user infant and also to provide support for the earpiece 11. A strap 24*b* runs front to back and attaches to the band 20 providing support and adjustment similar to strap 23*a*. Straps 23*a* and 23*b* and the hook and loop fastener tabs 18, 25*a*, 25*b* and 25*c* enable customized fitting to a range of infant user head diameters and shapes within the fit range of a particular sized cap 10.

The tubing 31 is shown are examples of medical apparatus commonly used with preterm infants, or infants with respiratory complications. The tubing 31 is commonly used for continuous positive airway pressure (CPAP) therapy and/or for nasal cannula (NC) tubing. Routing and maintaining the position of such tubing is often problematic and conventional solutions can result in skin irritation. As shown in FIG. 1, a guide 16 and a corresponding guide on the opposite side (not shown) provide a means of routing and retaining the tubing 13 in the proper position. In this embodiment, the guides 16 comprise tabs having hook and loop fasteners that enable the tab to loop over the tube 13 and be repositioned. In this embodiment cable ties 14 are used to attach any wires running to and/or from the cap 10.

The cap 10 may be advantageously used as part of a diurnal rhythm regimen. A diurnal rhythm regimen typically comprises defined activity periods which include an Ambient Auditory and Visual Environment (AAVE), during which the infant is exposed to normal audio and visual stimuli, and a Protected Auditory and Visual Environment (PAVE), during which audio and visual stimuli to the infant are reduced. Typically, the PAVE period is intended to correspond to periods of time (a total of 8-16 hours per day) in which the infant should be sleeping. The frequency and duration of PAVE periods could vary based on many factors, including the specific needs of the infant and as well as the infant's age.

During a PAVE period, the audio device, earpieces 11 and eye shade 22 are preferably configured to reduce audio and visual stimuli. For example, the audio device could be set to reduce the audio level of rebroadcast ambient sounds by 30 dB and the eye shade 22 positioned to cover the infant's eyes. Conversely, during an AAVE period, the eye cover 22 would be removed from the infant's eyes and the audio device could be set to rebroadcast ambient sounds without reducing audio levels. Alternatively, the earpieces 11 could be removed during AAVE periods.

It is recognized by those skilled in the art that changes may be made to the above-described embodiments of the invention without departing from the broad inventive concept thereof. It is understood, therefore, that this invention is not limited to the particular embodiments disclosed but is intended to cover all modifications which are in the spirit and scope of the invention.

The invention claimed is:

1. A method comprising:

a) attenuating noise to left and right ears of an infant by placing a headwear on a head of the infant, the headwear including left and right earpieces that provide sound attenuation of at least 20 dBA;

b) exposing the left and right ears to ambient sounds without substantial attenuation; and c) performing steps a) and b) in accordance with a sleep schedule for the infant, wherein step b) comprises rebroadcasting the ambient sounds through the left and right earpieces.

2. The method of claim 1, further comprising:

sampling sounds from a first person, the sounds selected from the group of: respiration sounds, cardiovascular sounds, bowel sounds, digestive sounds;

playing the sampled sounds through an audio device that is positioned to be heard by the infant.

3. The method of claim 1, wherein step a) is performed during a portion of the sleep schedule during which the infant should be sleeping.

4. A method comprising:

providing an infant with an ambient auditory and visual environment (AAVE), during which the infant is exposed to ambient audio stimuli, wherein the AAVE comprises placing the earpieces over the infant's ears and rebroadcasting ambient sounds without reducing audio levels;

providing an infant with a protected auditory and visual environment (PAVE), during which audio stimuli to the infant is reduced by placing earpieces on the infant's ears which reduce ambient audio levels by at least 20 dB; and alternating between periods of AAVE and PAVE in accordance with a sleep schedule for the infant.

5. The method of claim 4, further comprising: providing the infant with the protected auditory and visual environment, during which visual stimuli is reduced by placing an eye shade over the infant's eyes, the eye shade being opaque or semi-opaque.

6. The method of claim 5, further comprising the step of exposing the infant to phototherapy during the PAVE period.

7. The method of claim 4, wherein the PAVE further comprises playing sampled sounds through an earphone located in each of the earpieces, the sounds selected from the group of: respiration sounds, cardiovascular sounds, and digestive sounds.

8. The method of claim 4, wherein the PAVE period is between about 8 and about 16 hours per day.

* * * * *